US007808171B2

(12) United States Patent
Sato et al.

(10) Patent No.: US 7,808,171 B2
(45) Date of Patent: Oct. 5, 2010

(54) IMAGE DISPLAY DEVICE HAVING RESISTANCE LAYER CONFIGURATION

(75) Inventors: Masamitsu Sato, Hiratsuka (JP); Hirotaka Murata, Fukaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 425 days.

(21) Appl. No.: 11/766,825

(22) Filed: Jun. 22, 2007

(65) Prior Publication Data

US 2007/0257599 A1 Nov. 8, 2007

Related U.S. Application Data

(63) Continuation of application No. PCT/JP2005/022358, filed on Dec. 6, 2005.

(30) Foreign Application Priority Data

Dec. 24, 2004 (JP) ..... 2004-374949

(51) Int. Cl.
*H01J 1/62* (2006.01)

(52) U.S. Cl. ..... 313/496; 313/495; 315/169.3

(58) Field of Classification Search ..... 313/495–497
See application file for complete search history.

(56) References Cited

U.S. PATENT DOCUMENTS 5,592,056 A * 1/1997 Peyre et al. ..... 315/169.1
5,764,000 A * 6/1998 Mougin et al. ..... 313/496
6,771,236 B1 * 8/2004 Konishi et al. ..... 345/80
7,221,085 B2 * 5/2007 Murata et al. ..... 313/496
2005/0179398 A1 * 8/2005 Onishi ..... 315/169.2

FOREIGN PATENT DOCUMENTS

EP 1 681 704 A1 7/2006
EP 1 821 331 A1 8/2007
JP 10-326583 12/1998
JP 2000-251797 9/2000
JP 2001-243893 9/2001
JP 2002-175764 A 6/2002

(Continued)

OTHER PUBLICATIONS

Machine English translation of JP 2005-268109 to Onishi.*

(Continued)

*Primary Examiner*—Sikha Roy
(74) *Attorney, Agent, or Firm*—Fitzpatrick, Cella, Harper & Scinto

(57) ABSTRACT

An image display device includes a front plate and a rear plate opposing the front plate, the front plate being provided with phosphor film segments, resistance layers provided between the phosphor film segments, metal back layer segments provided on the phosphor film segments and the resistance layers, and high-voltage applying means which applies a high voltage to the metal back layer segments, the metal back layer segments being obtained by dividing a metal back layer along a first axis X with gaps Gx therebetween and along a second axis Y with gaps Gy (Gy>Gx) therebetween, the rear plate being provided with a plurality of electron emission elements. Those of the resistance layers which are provided in areas existing between the gaps Gy include first resistance layer segments adjacent to the phosphor film segments, and second resistance layer segments adjacent to the first resistance layer segments.

2 Claims, 2 Drawing Sheets

FOREIGN PATENT DOCUMENTS

| | | | |
|---|---|---|---|
| JP | 2003-229074 | A | 8/2003 |
| JP | 2004-47408 | A | 2/2004 |
| JP | 2004-158232 | | 6/2004 |
| JP | 2005-268109 | A | 9/2005 |
| WO | 2005/038850 | A1 | 4/2005 |

OTHER PUBLICATIONS

European Communication and Search Report dated Dec. 8, 2009, regarding European Application No. 05814532.7-2208.

* cited by examiner

IMAGE DISPLAY DEVICE HAVING RESISTANCE LAYER CONFIGURATION

CROSS-REFERENCE TO RELATED APPLICATIONS

This is a Continuation Application of PCT Application No. PCT/JP2005/022358, filed Dec. 6, 2005, which was published under PCT Article 21(2) in Japanese.

This application is based upon and claims the benefit of priority from prior Japanese Patent Application No. 2004-374949, filed Dec. 24, 2004, the entire contents of which are incorporated herein by reference.

BACKGROUND OF THE INVENTION

1. Field of the Invention

The present invention relates to an image display device in which an electron beam is emitted from an electron emission element to a phosphor screen to display an image.

2. Description of the Related Art

In recent years, flat-panel image display devices have been developed as next-generation image display devices, in which a large number of electron emission elements oppose a phosphor screen. Although there are various types of electron emission elements, they basically utilize field emission. Display devices employing electron emission elements are generally called field emission displays (hereinafter referred to as "FEDs"). Among the FEDs, display devices using surface-conduction type electron emission elements are also called surface-conduction type electron emission displays (hereinafter referred to as "SEDs"). In this specification, the term "FED" is used as a collective term including SEDs.

Each FED has front and rear plates opposing each other with a narrow gap of about 1-2 mm, the peripheries of the plates being coupled to each other by a rectangular frame serving as side walls, thereby forming an evacuated envelope. The interior of the evacuated envelope is kept in a highly evacuate state of about $10^{-4}$ Pa. Further, a plurality of spacers are provided between the front and rear plates to support the plates on which the atmospheric pressure exerted.

A phosphor screen including red, blue and green phosphor film segments is formed on the inner surface of the front plate, while a large number of electron emission elements for emitting electron beams to activate the phosphor screen to emit light are provided on the inner surface of the rear plate. Further, a large number of scanning lines and signal lines are formed in a matrix and connected to the electron emission elements. An anode voltage is applied to the phosphor screen. When electron beams emitted from the electron emission elements are accelerated by the anode voltage and applied to the phosphor screen, the phosphor screen emits light to display thereon an image.

To obtain practical display characteristics in the FED constructed as above, it is necessary to use a phosphor screen similar to a standard cathode ray tube, and to form, on the phosphor screen, an aluminum thin film called a metal back film. In this case, it is desirable that the anode voltage applied to the phosphor screen be set to several kV, at least, and, if possible, to 10 kV or more.

However, the gap between the front and rear plates cannot be set so large in view of the resolution or the characteristics of the spacers, and need be set to about 1 to 2 mm. Accordingly, in FEDs, a strong electric field inevitably occurs in the small gap between the front and rear plates, which means that discharge may occur between the plates.

If no countermeasures are taken to suppress damage due to discharge, destruction or degradation of electronic emission elements, phosphor screen, driver IC discharge and driving circuits may well occur. These destruction and degradation, etc., will hereinafter be referred to as "discharge damage-."Under the circumstances that will cause such damage, in order to put FEDs to practical use, it is required to absolutely prevent discharge from occurring, for a long time. However, this is very difficult to realize.

Therefore, it is important to take measurements for reducing a discharge current to a level that enables discharge damage to be avoided or minimized to an ignorable extent. As a technique for this, a technique of segmenting a metal-back film (generally, an anode) is known. Metal-back segmentation can be mainly classified into first-dimensional segmentation in which the metal back film is divided only along one axis to form metal film strips, and second-dimensional segmentation in which the metal back film is separated along two axes to form metal film islands. Second-dimensional segmentation can make discharge current smaller than first-dimensional segmentation. The present invention relates to second-dimensional segmentation, and hence a publicly known example concerning first-dimensional segmentation is not shown in this description. Concerning the basic structure of the latter, see Jpn. Pat. Appln. KOKAI Publication No. 10-326538. Second-dimensional segmentation is disclosed in Jpn. Pat. Appln. KOKAI Publications Nos. 10-326538, 2001-243893 and 2004-158232.

When a metal back film is segmented, it is necessary to secure a route for a beam current in order to suppress a reduction in brightness within an allowable range, and also necessary to prevent discharge due to a potential difference that occurs between the gaps of the separated metal back layer segments. Regarding this point, Jpn. Pat. Appln. KOKAI Publications Nos. 10-326538 and 2004-158232 disclose a structure in which resistance layers are interposed between separated metal back layer segments. Further, Jpn. Pat. Appln. KOKAI Publication No. 2001-243893 discloses a structure in which separated metal back layer segments are connected to a power supply line extending close to them via respective resistance layers. Jpn. Pat. Appln. KOKAI Publication No. 2000-251797 also discloses interposition of resistance layers between metal back layer segments, although it contains no embodiments related to second-dimensional segmentation.

In the configuration of a typical FED, R, G and B pixels are arranged in the X-axis. Further, in general, it is preferable that R, G and B pixels are arranged in a square or substantially square matrix. Accordingly, in second-dimensional division, the X-axial (horizontal) gap Gx of separated metal back layer segments is smaller than the (vertical) Y-axial gap Gy of the separated metal back layer segments.

In general, in second-dimensional segmentation, it is important to set the resistance Rx across the gap Gx and the resistance Ry across the gap Gy to respective preset values. It can be understood from Jpn. Pat. Appln. KOKAI Publications Nos. 10-326538, 2001-243893, 2004-158232 and 2000-251797 that conventionally, the resistance Rx is assumed to actually be adjusted by a resistance layer provided in the gap Gx. However, since the gap Gx is small, a highly accurate process is required to form such a structure, which is not desirable for mass production. Further, to minimize discharge current, it is desirable to maximize the resistance Rx. In this case, high voltage occurs at the gap Gx during discharge and hence discharge may occur at the gap Gx. To avoid this, it is desirable to maximize the gap Gx so as to increase the withstand voltage. However, when the resistance Rx is adjusted by a resistance layer provided in the gap Gx, it is also necessary to secure a contact area between each separated metal back layer segment and resistance layer. This is an obstacle to broaden the gap Gx.

BRIEF SUMMARY OF THE INVENTION

It is an object of the invention to provide an image display device excellent in mass productivity and discharge-current reduction performance.

An image display device according to the invention includes a front plate and a rear plate opposing the front plate, the front plate being provided with phosphor film segments, resistance layers provided between the phosphor film segments, metal back layer segments provided on the phosphor film segments and the resistance layers, and high-voltage applying means which applies a high voltage to the metal back layer segments, the metal back layer segments being obtained by dividing a metal back layer along a first axis X with gaps Gx therebetween and along a second axis Y with gaps Gy (Gy>Gx) therebetween, the rear plate being provided with a plurality of electron emission elements. The image display device is characterized in that those of the resistance layers which are provided in areas existing between the gaps Gy include first resistance layer segments adjacent to the phosphor film segments, and second resistance layer segments adjacent to the first resistance layer segments.

In the invention, it is preferable that the first resistance layer segments and the second resistance layer segments are shaped like strips extending along the first axis X.

Further, third resistance layer segments having a specific resistance greater than the first resistance layer segments may be provided in the gaps Gx. The third resistance layer segments are not indispensable and may be arbitrarily provided. When the third resistance layer segments are employed, it is necessary to set them to a sufficiently high specific resistance.

DETAILED DESCRIPTION OF THE INVENTION

A best mode for embodying the invention will be described with reference to the accompanying drawings.

Figure 2:
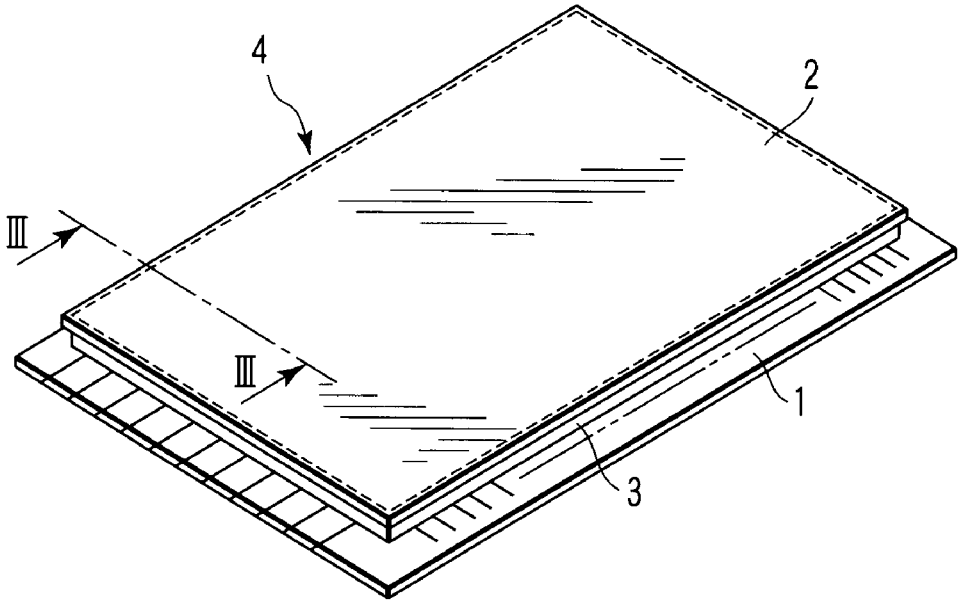
FIG. 2 is a perspective view illustrating the outline of a standard image display device (FED)
Figure 3:
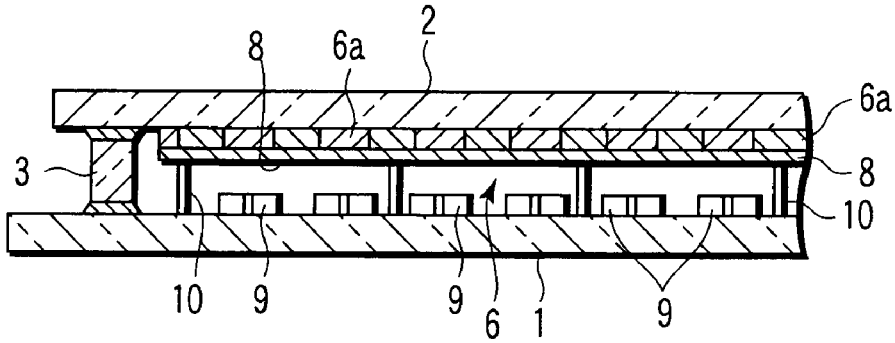
FIG. 3 is a sectional view taken along line III-III of FIG. 2.

Referring first to FIGS. 2 and 3, the structure of a general FED, to which the invention is applied, will be described. As shown, the FED comprises a front plate 2 and rear plate 1 formed of rectangular glass, opposing each other with a gap of 1 to 2 mm therebetween. The inner peripheral edges of the front and rear plates 1 and 2 are bonded to each other via a rectangular frame 3, thereby forming an evacuated, flat rectangular envelope 4 with its interior maintained at a highly evacuated state of about $10^{-4}$ Pa.

A phosphor screen 6 is formed on the inner surface of the front plate 2. The phosphor screen 6 includes phosphor film segments 6*a* that can emit red, blue and green light. Metal-back layer segments 8 serving as anodes are formed on the phosphor screen 6.

A large number of electron emission elements 9 for emitting electron beams to activate the phosphor film segments 6*a* are provided on the inner surface of the rear plate 1. The electron emission elements 9 are arranged in rows and columns, corresponding to the phosphor film segments 6*a*, and are driven by wires (not shown) arranged in a matrix.

Further, a plurality of plate-like or columnar spacers 10 as reinforcing members for resisting the atmospheric pressure are provided between the front and rear plates 2 and 1.

An anode voltage is applied to the metal back layer segments 8 via appropriate high-voltage applying means (not shown) from the outside of the FED. When electron beams emitted from the electron emission elements are accelerated by the anode voltage and applied to the phosphor film segments 6*a*, an image is displayed.

Figure 1:
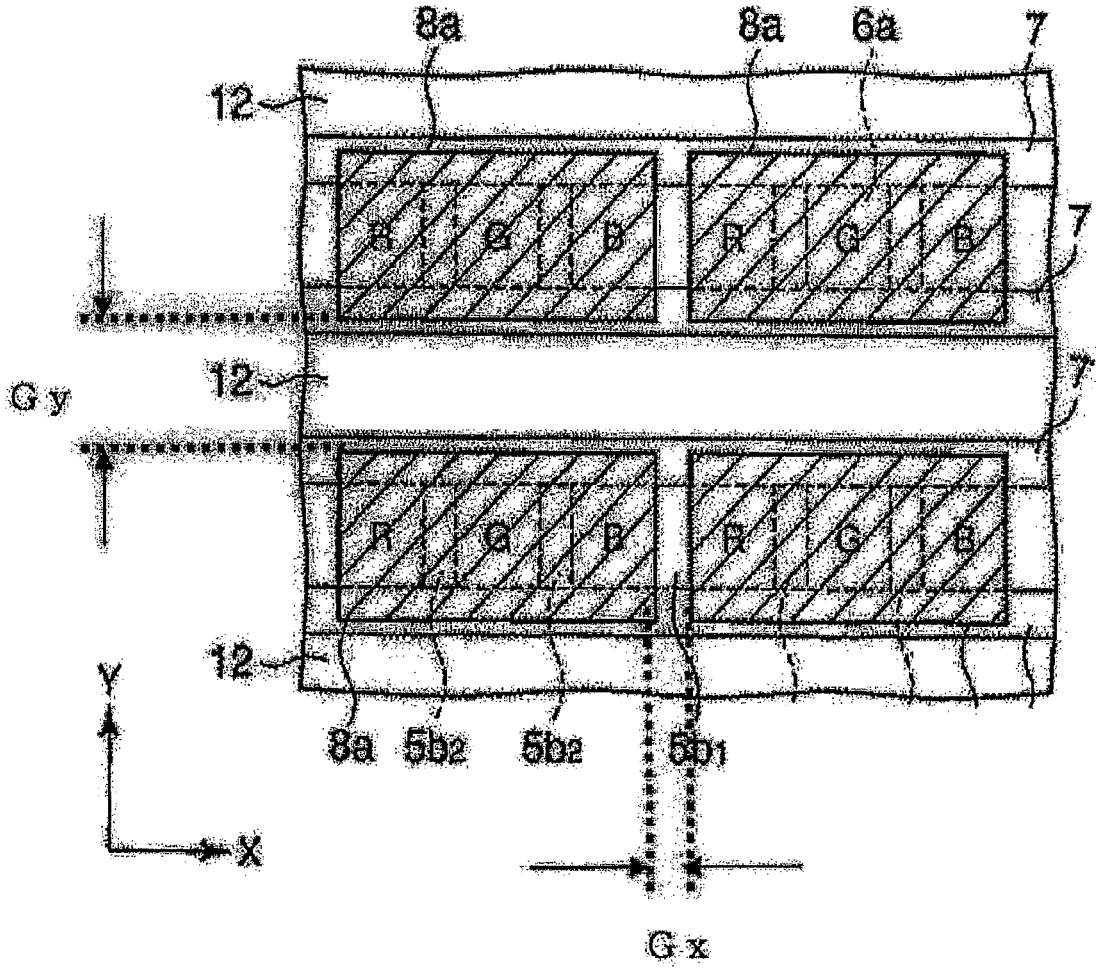
FIG. 1 is a plan view illustrating the phosphor screen of an image display device (FED) according to an embodiment of the invention.

Referring then to FIG. 1, a description will be given of the structure of the phosphor screen 6 of an image display device (FED) according to a preferable embodiment of the invention.

The phosphor screen 6 includes a large number of rectangular phosphor film segments 6*a* that can emit red (R), green (G) and blue (B) light. Assuming that the FED is a typical FED with a laterally elongated screen, the phosphor film segments 6*a* that can emit red (R), green (G) and blue (B) beams are repeatedly arranged with preset pitches along the X- and Y-axes, the X-axis being the major axis and the Y-axis being the minor axis. The preset pitches may be varied within an allowable tolerance range in manufacture or design.

First resistance layer strips 7 extending along the X-axis are provided on both sides of the phosphor film segments 6*a*. Hereinafter, values corresponding to FEDs for typical large TV sets that employ a pixel pitch of about 600 μm will be shown as numerical value examples. The first resistance layer strips 7 have a width of, for example, about 30 to 100 μm. Further, second resistance layer strips 12 extending along the X-axis are provided between respective pairs of adjacent ones of the first resistance layer strips 7. The first resistance layer strips 7 have a width of about 150 to 350 μm. Third resistance layer pieces 5*b*1 and 5*b*2 are provided in the X-axial gaps of the phosphor film segments 6*a*. The third resistance layer pieces 5*b*1 and 5*b*2 have a width of about 30 to 100 μm. These first to third resistance layer pieces can be formed by a known technique such as photolithography. Since the second resistance layer strips 12 have a wide width, it is easy to employ screen printing to form them. Further, note that the resistance layer pieces 5*b*2 do not have a function of adjusting the resistances between the separated metal back layer segments, and hence the portions corresponding to the resistance layer pieces 5*b*2 may be buried with the phosphor film segments 6*a*, instead of the resistance layer pieces 5*b*2.

Separated metal back layer segments 8*a* obtained by two-dimensionally segmentation a metal back layer segment are formed on at least the greater part of the phosphor film segments 6*a*, and on at least part of the first resistance layer strips. In FIG. 1, Gx denotes X-axial gaps between the separated metal back layer segments 8*a*, and Gy denotes Y-axial gaps between the separated metal back layer segments 8*a*. Since the R, G and B phosphor film segments are arranged along the X-axis, Gx<Gy.

In FIG. 1, each separated metal back layer segment 8*a* covers a corresponding set of R, G and B film segments. However, the pitch of division can be set arbitrarily in view of the discharge current specification or convenience in process.

In general, in two-dimensional segmentation, it is important to set, to respective preset values, the resistance Rx of the gap Gx and the resistance Ry of the gap Gy.

In the case of, for example, FEDs for typical large TV sets, the gap Gy is 200 to 300 μm, and the gap Gx is 50 μm or less. It can be understood from the patent documents cited in the section "Background Art," that conventionally, the resistance Rx is assumed to actually be adjusted by a resistance layer provided in the gap Gx. However, since the gap Gx is small, a highly accurate process is required to form such a structure, which is not desirable for mass production. Further, to minimize discharge current, it is desirable to maximize the resistance Rx. In this case, high voltage occurs at the gap Gx during discharge and hence discharge may occur at the gap Gx. To avoid this, it is desirable to maximize the gap Gx so as to increase the withstand voltage. However, when the resistance Rx is adjusted by a resistance layer provided in the gap Gx, it is also necessary to secure a contact area between each separated metal back layer segment and resistance layer. This is an obstacle to broaden the gap Gx. To realize secure contact even in consideration of positional errors, it is desirable to set the contact width to, for example, about 15 μm or more. In contrast, it is desirable to minimize the width of the third resistance layer pieces 5*b*1, in order to, for example, increase the pixel size. If the width is, for example, about 50 μm, the gap Gx will be as small as 20 μm (=50−2×15). Furthermore, to realize further microfabrication, the gap Gx may well be unable to be formed.

In the embodiment, the gap Gx can be set substantially equal to the interval between each pair of adjacent ones of the phosphor film segments 6*a*. This is because since the resistance Rx occurs in the areas on the upper and lower surfaces of the phosphor film segments 6*a*, the contact areas can be prevented from being reduced by the gaps Gx. Accordingly, in the above-mentioned numerical value examples, the gap Gx can be increased from 20 μm to 50 μm, i.e., can be doubled. The fact that the gap Gx can be widened is advantageous for mass production, and enables the withstand voltage of the gap Gx to be enhanced compared to the conventional structure, thereby reducing the current. Furthermore, the gaps Gx can be formed even in high-density FEDs in which the gaps Gx are hard to form in the prior art.

To make the resistance Rx occur in the areas on the upper and lower surfaces of the phosphor film segments 6*a*, the specific resistance of the third resistance layer pieces 5*b*1 is set higher than the first resistance layer strips 7. In the ultimate sense, the third resistance layer pieces 5*b*1 may be insulated. The specific resistance of the second resistance layer strips are not particularly limited, and is a design of choice.

The withstand voltages Vx of the gaps Gx in the FED of the embodiment and conventional FED were measured. In the FED of the embodiment, Vx=1.4 kV when the gap Gx is 50 μm, while in the conventional FED, Vx=0.8 kV when the gap Gx is 20 μm. Thus, the discharge current (which cannot directly be measure and hence is an expected value) can be reduced to a value half the conventional value or less. This means that the present invention enables even FEDs that must satisfy more restrict demands concerning discharge current to be made free from discharge damage.

In general, in FEDs, it is desirable to employ, between phosphor film segments, light-shielding films of black or a color close to it, in order to enhance the contrast of images displayed. The first to third resistance layer pieces may also serve as light-shielding films. If the material of the resistance layers is not suitable for shielding films, films dedicated to light shielding may be employed.

Depending upon the structure of the FED, a getter film may be provided on the metal back layer segment. Since getter films generally have low resistance, it is necessary to two-dimensionally segmentation them like the metal back layer segment. To this end, a technique of dividing (segmenting) a getter film in accordance with the unevenness of the surface, as disclosed in, for example, Jpn. Pat. Appln. KOKAI Publication No. 2003-068237 or 2004-335346, can be used.

It is not always necessary to form the third resistance layer pieces. Alternatively, the phosphor film segments 6*a* may be formed adjacent to each other along the X-axis. Also in this case, the resistance Rx is adjusted by the first resistance layer strips 7, since the phosphor film segments 6*a* in general are substantially insulated.

It is not always necessary to provide the first resistance layer strips 7 on the upper and lower surfaces of the phosphor film segments. Instead, they may be provided only on the upper or lower surface, or may be provided alternately on the upper and lower surfaces. Further, it is not always necessary to provide the first resistance layer strips for all phosphor film segments 6, but the former films may be provided for part of the latter films.

It is desirable for manufacturing to shape the first resistance layer strips 7 like simple strips. However, they may have a complex shape or have a discontinuous structure in which gaps or breaks are formed at some portions. The shape of the resistance layer strips 7 can be selected arbitrarily. It is sufficient if these films are formed in the gaps Gx to adjust the resistance Rx of each gap Gx.

On a landscape type screen, the X- and Y-axes typically correspond to the major and minor axes, respectively. However, the X- and Y-axes are generally determined depending upon whether Gx<Gy is satisfied. On typical screens, R, G and B pixels are arranged longitudinally, and hence the major axis is defined as the X-axis. However, depending upon the structure of an FED, the minor axis may be defined as the X-axis.

In the invention, the X-axial gaps Gx between the separated metal back layer segments can be widened. Therefore, the invention can provide an image display device excellent in mass productivity and discharge-current reduction performance.

What is claimed is:

1. An image display device including a front plate and a rear plate opposing the front plate, the front plate being provided with phosphor film segments, resistance layers provided between the phosphor film segments, metal back layer segments provided on the phosphor film segments, and high-voltage applying means which applies a high voltage to the metal back layer segments, the metal back layer segments being obtained by segmenting a metal back layer along a first axis X with gaps Gx therebetween and along a second axis Y with gaps Gy (Gy>Gx) therebetween, the first axis crosses the second axis Y, the rear plate being provided with a plurality of electron emission elements, the image display device being wherein:

the resistance layers in an area of the gap Gy include a pair of first resistance layer, stripes each arranged to contact with each of the metal back layer segments adjacent to each other sandwiching therebetween the area of the gap Gy, and to contact with each of the metal back layer segments adjacent to each other sandwiching therebetween the area of the gap Gx, wherein the pair of first resistance layer stripes extend in a direction along the first axis X a second resistance layer stripe arranged between the pair of first resistance layer stripes so as to contact with the pair of first resistance layer stripes wherein the second resistance layer stripe extends in the direction along the first axis X, and third resistance layer segments having a specific resistance greater than the first resistance layer are provided in the gaps Gx.

2. The image display device according to claim 1, wherein the first resistance layer segments and the second resistance layer segments are shaped like strips extending along the first axis X.

* * * * *